United States Patent [19]

Ikenoue et al.

[11] Patent Number: 4,648,903

[45] Date of Patent: Mar. 10, 1987

[54] IRON BASE SINTERED, WEAR-RESISTANT MATERIALS AND METHOD FOR PRODUCING THE SAME

[75] Inventors: Yutaka Ikenoue; Hiroyuki Endoh, both of Chiba; Kei Ishii, Kanagawa; Keitaro Suzuki, Chiba, all of Japan

[73] Assignee: Hitachi Powdered Metals Co., Ltd., Chiba, Japan

[21] Appl. No.: 705,628

[22] Filed: Feb. 28, 1985

[30] Foreign Application Priority Data

Apr. 10, 1984 [JP] Japan ..... 59-70129

[51] Int. Cl.[4] ..... C22C 38/16

[52] U.S. Cl. ..... 75/230; 75/246

[58] Field of Search ..... 75/230, 125, 126 R, 75/126 K, 246; 420/582

[56] References Cited

U.S. PATENT DOCUMENTS

| | | | |
|---|---|---|---|
| 3,986,867 | 10/1976 | Masumoto et al. | 75/126 K |
| 4,128,420 | 12/1978 | Espen et al. | 75/230 |
| 4,268,309 | 5/1981 | Serino et al. | 75/125 |
| 4,344,795 | 8/1982 | Endo et al. | 75/230 |

FOREIGN PATENT DOCUMENTS

| | | | |
|---|---|---|---|
| 157952 | 9/1983 | Japan | 75/125 |
| 499561 | 1/1939 | United Kingdom | 75/125 |
| 856646 | 12/1960 | United Kingdom | 75/125 |
| 897886 | 1/1982 | U.S.S.R. | 75/125 |

*Primary Examiner*—Herbert B. Guynn
*Assistant Examiner*—Eric Jorgensen
*Attorney, Agent, or Firm*—Burgess, Ryan & Wayne

[57] ABSTRACT

An iron base sintered, wear-resistant material consisting substantially of, in weight ratio, 3–25% of Cr, 0.1–2% of P, 0.5–3% of C, 1–13% of at least two elements selected from the group consisting of 0.5–7% Mo, 0.1–8% W, 0.1–3V and 0.5–2% Ni, 10–25% of Cu and the balance being essentially Fe.

6 Claims, 2 Drawing Figures

IRON BASE SINTERED, WEAR-RESISTANT MATERIALS AND METHOD FOR PRODUCING THE SAME

FIELD OF THE INVENTION

The present invention relates to an iron base sintered, wear-resistant material containing copper and, more particularly, to an iron base wear-resistant sintered alloy containing copper, which is best-suited for use in the parts or members forming a part of the valve mechanisms of internal combustion engines.

BACKGROUND OF THE INVENTION

Referring first to the OHC type valve mechanism that is a typical one of the conventional valve mechanisms, the rotation of a cam 2 causes seesaw movement of a rocker arm 1 around the axis thereof, thereby opening or closing a valve 3, as shown in FIG. 1. In such a valve mechanism, although the wear resistance of the arm 1 which comes into contact with the cam 2 is of importance, the wear resistance of the cam 2 per se is of great importance as well.

As the pad material for the sliding surface of a rocker arm, there is known a high-density material such, as high-speed steel or alloy steel, which is of a structure wherein finely divided carbide is dispersed throughout the martensite matrix, and has a porosity of about 2–3%. The present inventors developed this type of material, for which a Japanese Patent Application No. 55-181916 was filed, said application being now laid-open under No. 57-108245.

Such material, inter alia, an alloy material developed by the present inventors, shows extremely high wear resistance, and serves to reduce the abrasion of the pad. Nonetheless, improvement is required since the improved pad tends to rapidly abraid the associated cam.

SUMMARY OF THE INVENTION

A main object of the present invention is therefore to provide an iron base sintered wear-resistant material which serves to reduce substantially the abrasion of an associated member with which it comes into sliding contact, and of which the wear resistance per se is equal to or greater than that of the conventional material.

In accordance with the present invention, this object is achieved by providing an iron base having a composition wherein 0.15–3% by weight carbon and 10–25% by weight copper or a copper alloy are added to an alloy consisting substantially of, in weight %, 3–25% Cr, 0.1–2% P, 1–13% of at least two elements selected from the group (0.5–7% Mo, 0.1–8% W, 0.1–3% V and 0.5–2% Ni) and the balance being essentially Fe.

BRIEF DESCRIPTION OF THE DRAWINGS

The foregoing and other objects and features of the present invention will become apparent from reading the following detailed description with reference to the accompanying drawings, in which.

DETAILED DESCRIPTION OF THE INVENTION

In this application, it is understood that % means percent by weight.

Figure 1:
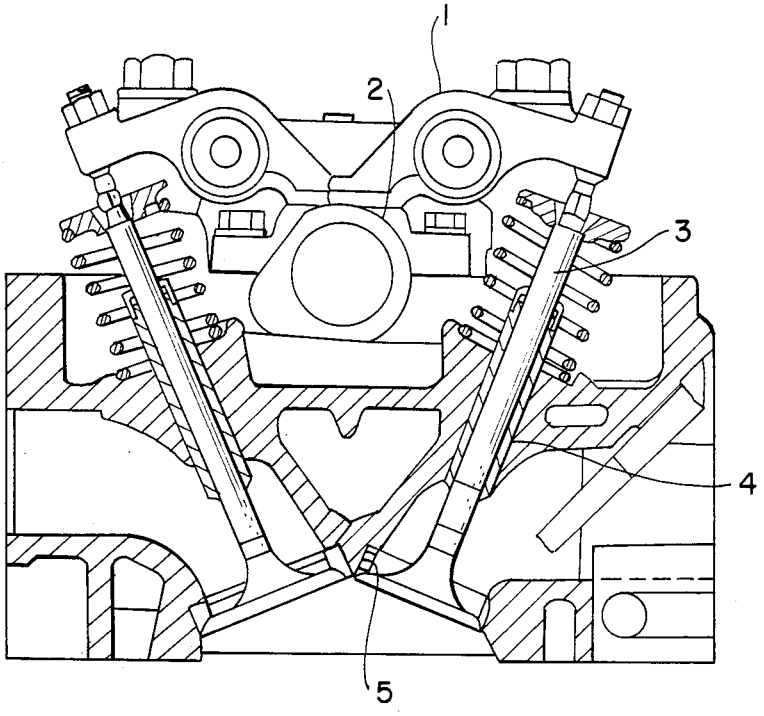
FIG. 1 is a view illustrative of the construction of a typical valve mechanism of an internal combustion engine.
Figure 2:
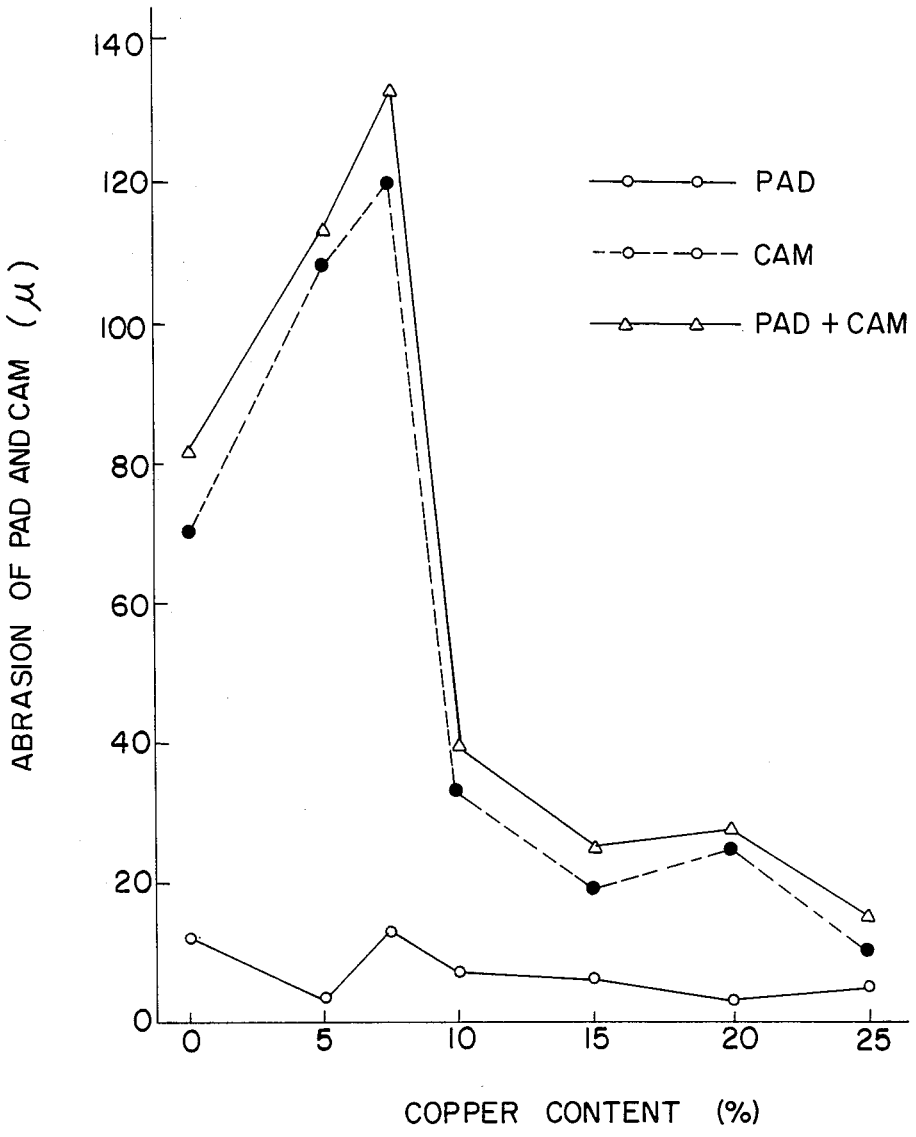
FIG. 2 is a graphical view showing the relation between copper content and abrasion.

In the present invention, 10–25% copper or a copper alloy (Cu-Sn, Cu-Ni) is added to the powders of alloy steel from which carbide precipitates after sintering. After sintering, the soft copper or copper phase is dispersed throughout the matrix, making use of the compatibility thereof. However, when the amount of copper is below 10%, the bulk thereof forms a solid solution with the matrix, thus making it hard. The number of free copper phases decreases correspondingly, so that the associated member tends to wear away. When the amount of copper exceeds 25%, on the other hand, sweating of copper takes place during sintering, or deformation of the sintered body occurs. It goes without saying that excessive addition of expensive copper or copper alloys is not desirable. The relation between the amount of copper and the abrasion is shown in the graph of FIG. 2.

Carbon is usually added with the copper alloy powder in the form of graphite powder, which serves to strengthen the matrix, and reacts with chromium and other additive components to precipitate a hard phase for improving wear resistance. In an amount of less than 0.5%, however, the carbon causes the matrix to be composed mainly of ferrite, so that a considerable lowering of strength takes place. On the other hand, an amount exceeding 3% has adverse effects such as segregation of mixed powders, a lowering of apparent density, deterioration in forming properties, etc.

In what follows, the alloy powders used as the main starting material in the present invention will be explained.

To add alloy elements for the purpose of improving wear resistance is old. In view of the their behavior, effect and action, the additive alloys are broken down into two general classes, one forming carbides (for instance, Cr, Mo, V,, W, etc.) and the other forming solid solutions with the matrix, thus strengthening the structure, for instance, Ni. Both classes of elements serve to improve the wear resistance of sliding parts which are subjected to high pressures thus bringing about mechanical oil film deficiency. The respective additive elements and the compositional range thereof are as follows.

CHROMIUM

While strengthening the matrix, it reacts with carbon to form a hard carbide, which results in improvements in wear resistance. However, no desired effect is attained in an amount of less than 3%. On the other hand, an amount exceeding the upper limit of 25% causes embrittlement of the resulting alloy, and tends to mar the associated cam member.

PHOSPHORUS

This element takes part in liquid phase sintering, through which the sintered body is densified. No desired effect is attained in an amount of less than 0.1%; however, an amount exceeding 2% is not desirable in that an excessive amount of liquid phase occurs, leading to a large dimensional change during sintering.

MOLYBDENUM

Like chromium, this element serves to strengthen the matrix, and reacts with carbon to form a hand carbide, thereby introducing improvements in wear resistance. However, the addition of Mo in an amount exceeding 7% tends to mar the associated cam part.

TUNGSTEN

Like chromium, this element serves to strengthen the matrix, and reacts with carbon to form a hard carbide which improves wear resistance. However, no desired effect is attained in an amount of less than 0.1%; on the other hand, the addition of tungsten in an amount exceeding 8% causes embrittlement of the material.

VANADIUM

This element reacts with carbon to form a carbide, which improves wear resistance. However, no desired effect is attained in an amount of less than 0.1%; on the other hand, the addition of this element in an amount exceeding 3% produces a drop in grindability, and tends to mar the associated material.

NICKEL

Nickel forms a solid solution with the matrix alloy to improve the strength and wear resistance thereof. In an amount of less than 0.5%, however, the quantity of the solid solution formed is so small that no desired effect is seen. When nickel is added in an amount exceeding 2%, on the other hand, it has an increased effect upon the decomposition of the carbides of Cr and other elements, resulting in an adverse influence such as a lowering of wear resistance.

Of these elements, Mo, W and V and Ni are used in combination depending upon intended purposes, provided that the combined amount thereof should be within the range of 1–13% for the following reasons. When the combined amount is less than 1%, it is impossible to obtain carbide passes which assure the desired effect; on the other hand, a total amount exceeding 13% leads to embrittlement, and tends to mar the associated cam part.

The production of the sintered alloys according to the present invention involves the mixing, forming sintering and heat treating of the starting powders which are usually employed in powder metallurgy. A preferred sintering temperature is 1130° C., and a preferred reducing atmosphere for sintering is cracked ammonia gas. It is also preferred for heat treating that oil-quenching be conducted from 900° C. in argon gas, and subsequent tempering be done at 180° C.

The typical compositions of the alloys according to the present invention are given below for the purpose of illustration alone.

| | | |
|---|---|---|
| Composition 1 | 3–7% Cr | 0.1–2% P |
| | 0.5–3% C | 0.5–1.5% Mo |
| | 0.5–7% W | 0.1–3% V |
| | 10–25% Cu | bal Fe |
| Composition 2 | 4.5–5.5% Cr | 0.1–2% P |
| | 0.5–3% C | 1–1.5% Mo |
| | 0.8–1.5% V | 10–25% Cu |
| | bal Fe | |
| Composition 3 | 3.8–4.5% Cr | 0.1–2% P |
| | 0.5–3% C | 4.5–5.5% Mo |
| | 5.5–6.7% W | 1.6–2.2% V |
| | 10–25% Cu | bal Fe |
| Composition 4 | 11–13% Cr | 0.1–2% P |

-continued

| | | |
|---|---|---|
| | 0.5–3% C | 0.8–1.2% Mo |
| | 0.2–0.5% V | 10–25% Cu |
| | bal Fe | |
| Composition 5 | 10–13% Cr | 0.1–2% P |
| | 0.5–3% C | 5–6% Mo |
| | 0.8–1% W | 0.9–1.3% V |
| | 10–25% Cu | bal Fe |
| Composition 7 | 23–25% Cr | 0.1–2% P |
| | 0.5–3% C | 1–3% Mo |
| | 0.1–1% W | 0.5–2% V |
| | 10–25% Cu | bal Fe |

It is undrestood that the present invention includes compositions obtained by substituting copper with the same amount of a copper alloy in the foregoing compositions.

The present invention will now be illustrated in further detail with reference to the following examples.

PREPARATION OF SAMPLES

Graphite powders, copper powders (or copper alloys powders in some experiment runs) and alloy powders save these two components were weighed in the proportions as specified in Tables 1 and 2, followed by addition of zinc stearate, a lubricant, in an amount of 1%. Mixing was done for 20 minutes in a V-type mixer.

The reasons for using the alloy powders are that the preparation of experiments is easy; and the tendencies of the properties of the resulting sintered material are clearly noted due to a small fluctuation therein.

The mixed powders were then formed into given pads at a pressure of 6 t/cm$^2$, which were sintered at 1130° C. for 30 minutes in cracked ammonia gas and heat-treated under the following conditions. The tables also show the found density ratio and hardness of the samples.

Quenching: Oil-quenching in argon gas
Quenching Temperature: 900° C.
Tempering Temperature: 180° C.

TEST METHOD

Use was made of a motoring tester device (one type of simulation device wherein the cam shaft is rotated by a motor to effect various tests of the valve mechanism) using an OHC type four-cylinder 1800 cc engine. The pad of a rocker arm, to which each of the samples was attached, was incorporated into that testing device, and testing was carried out under the following conditions to measure the abrasion or wear loss of the pad and the associated cam.

Cam Material: Chilled cast iron
Revolutions: 650 r.p.m.
Test Period: 50-hour continuous operation
Lubricating oil: Ordinary engine oil to which water was in 2.5% volume ratio to make the wearing conditions severe.

TEST RESULTS

The results of the tests intended to improve the alloys according to the aforesaid Japanese Patent Laid-Open Publication No. 57-108245 are set out in Table 1. Sample No. 1 refers to the alloy known from the said publication. Sample Nos. 2 and 3 are control runs wherein the copper content is less than 10%, while Sample Nos. 4 to 7 inclusive are the examples according to the present invention, wherein the proper amount of copper is used. Sample Nos. 8 and 9 are the inventive examples wherein the copper of Sample No. 6 is substituted with the same amount of copper alloys.

From Table 1 and the graph of FIG. 2, it is found that the addition of copper to the starting composition causes wearing of the associated cam part at the outset, but, as the copper content is increased to more than 10%, wearing of the cam unexpectedly decreases to a considerable degree. Such new findings underlie the present invention. Nos. 8 and 9 are the inventive examples wherein copper is substituted with Cu-Sn and Cu-Ni alloys, respectively, which means that the copper and the copper alloy are an equivalent material in view of the object of the present invention. It is noted that the use of copper alloys results in a somewhat increase in the cost.

Sample Nos. 10 to 13 inclusive illustrate the effect of P. Nos. 10 and 13 departing from the scope of the present invention are found to be larger in the wearing losses than Nos. 11 and 12, the examples of the present invention. The same as referred to in the case of P holds for Examples 14 to 17 inclusive, which illustrate the effect of C.

The improvements achieved by adding copper to the existing alloys such as H-13 are shown in Table 2. The each sample in the first line in each column sectioned by the solid line corresponds to the alloy specifications described in "Remarks" in the table.

Referring to Sample Nos. 18 to 24 inclusive, the inventive Sample Nos. 21 to 24 decrease in the total wearing losses to ⅓ or less of Sample No. 18, which means the effect of copper addition is significant. In Sample Nos. 19 and 20 having a copper content of less than 10%, the wearing losses rather increases.

M-2 (Sample Nos. 25 to 31 inclusive) shows a substantially similar tendency. In the inventive Sample Nos. 28–31, the wearing losses of the cams and the total wearing losses decrease considerably, while the effect of copper addition is insignificant in Sample Nos. 26 and 27.

Sample Nos. 32 to 39 inclusive are self-explanatory.

As will be appreciated from the data given in both tables, the alloys of the present invention are very advantageous in that they do not only excel in wear resistance, but also serve to markedly reduce the abrasion of the associated cam part, compared with the prior art alloys. Thus, the alloys according to the present invention are applicable to the aforesaid pads of rocker arms as well as other various members such as the vanes of vane pumps, the cams of cam shafts, valve seat rings, etc.

TABLE 1

| Sample | Composition (%) | | | | | | | | | | Wearing of Pad | Wearing of Cam | Total Wearing | Density Ratio | Hardness |
|---|---|---|---|---|---|---|---|---|---|---|---|---|---|---|---|
| No. | Cr | Mo | W | V | Ni | P | Cu | C | Fe | Remarks | μ | μ | μ | % | HRC |
| 1 | 5.4 | 0.5 | 1.7 | 0.1 | — | 0.5 | — | 2.0 | bal. | P57-108245 | 12 | 70 | 82 | 97 | 63 |
| 2 | " | " | " | " | " | " | 5.0 | " | " | | 3 | 109 | 112 | 97 | 62 |
| 3 | " | " | " | " | " | " | 7.5 | " | " | | 13 | 120 | 133 | 97 | 60 |
| 4 | " | " | " | " | " | " | 10.0 | " | " | | 7 | 33 | 40 | 98 | 59 |
| 5 | " | " | " | " | " | " | 15.5 | " | " | Cu Effect | 6 | 19 | 25 | 98 | 55 |
| 6 | " | " | " | " | " | " | 20.0 | " | " | | 2 | 25 | 27 | 97 | 54 |
| 7 | " | " | " | " | " | " | 25.0 | " | " | | 5 | 10 | 15 | 96 | 53 |
| 8 | " | " | " | " | " | " | 20.0 | " | " | Cu→Cu→10 Sn | 10 | 6 | 16 | 96 | 55 |
| 9 | " | " | " | " | " | " | 20.0 | " | " | Cu→Cu→30 Ni | 8 | 5 | 13 | 96 | 55 |
| 10 | " | " | " | " | " | 0.07 | 20.0 | " | " | | 42 | 41 | 83 | 89 | 48 |
| 11 | " | " | " | " | " | 0.1 | " | " | " | | 20 | 18 | 38 | 94 | 52 |
| 12 | " | " | " | " | " | 2.0 | " | " | " | P Effect | 5 | 28 | 33 | 98 | 55 |
| 13 | " | " | " | " | " | 2.3 | " | " | " | | 18 | 46 | 64 | 98 | 57 |
| 14 | " | " | " | " | " | 0.5 | 20.0 | 0.3 | " | | 105 | 59 | 164 | 88 | 30 |
| 15 | " | " | " | " | " | " | " | 0.5 | " | | 83 | 35 | 118 | 93 | 39 |
| 16 | " | " | " | " | " | " | " | 3.0 | " | C Effect | 8 | 29 | 37 | 98 | 57 |
| 17 | " | " | " | " | " | " | " | 3.3 | " | | 12 | 47 | 59 | 98 | 60 |

TABLE 2

| Sample | Composition (%) | | | | | | | | | | Wearing of Pad | Wearing of Cam | Total Wearing | Density Ratio | Hardness |
|---|---|---|---|---|---|---|---|---|---|---|---|---|---|---|---|
| No. | Cr | Mo | W | V | Ni | P | Cu | C | Fe | Remarks | μ | μ | μ | % | HRC |
| 18 | 5.3 | 1.2 | — | 1.4 | — | 0.5 | — | 2.0 | bal. | Corresponding | 10 | 68 | 78 | 98 | 62 |
| 19 | " | " | " | " | " | " | 5.0 | " | " | to H-13 | 4 | 121 | 125 | 98 | 60 |
| 20 | " | " | " | " | " | " | 7.5 | " | " | | 10 | 108 | 118 | 98 | 59 |
| 21 | " | " | " | " | " | " | 10.0 | " | " | | 8 | 18 | 26 | 97 | 57 |
| 22 | " | " | " | " | " | " | 15.0 | " | " | | 6 | 19 | 25 | 98 | 55 |
| 23 | " | " | " | " | " | " | 20.0 | " | " | | 6 | 12 | 18 | 97 | 54 |
| 24 | " | " | " | " | " | " | 25.0 | " | " | | 3 | 10 | 13 | 97 | 53 |
| 25 | 4.2 | 4.9 | 6.0 | 2.1 | — | 0.4 | — | 2.0 | bal. | Corresponding | 5 | 65 | 70 | 98 | 59 |
| 26 | " | " | " | " | " | " | 5.0 | " | " | to M-2 | 5 | 60 | 65 | 97 | 56 |
| 27 | " | " | " | " | " | " | 7.5 | " | " | | 6 | 61 | 67 | 97 | 52 |
| 28 | " | " | " | " | " | " | 10.0 | " | " | | 2 | 21 | 23 | 98 | 50 |
| 29 | " | " | " | " | " | " | 15.0 | " | " | | 5 | 18 | 23 | 97 | 50 |
| 30 | " | " | " | " | " | " | 20.0 | " | " | | 8 | 20 | 28 | 96 | 49 |
| 31 | " | " | " | " | " | " | 25.0 | " | " | | 10 | 17 | 27 | 96 | 47 |
| 32 | 11.8 | 1.0 | — | 0.3 | — | 0.5 | — | 2.0 | bal. | Corresponding | 18 | 84 | 102 | 98 | 66 |
| 33 | " | " | " | " | " | " | 20.0 | " | " | to D2 | 12 | 25 | 37 | 98 | 57 |
| 34 | 14.5 | 5.5 | 0.9 | 1.2 | — | 0.5 | — | 2.0 | bal. | | 31 | 79 | 110 | 97 | 64 |
| 35 | " | " | " | " | " | " | 20.0 | " | " | | 15 | 13 | 28 | 98 | 55 |
| 38 | 25.0 | 2.0 | 0.4 | 1.0 | — | 0.5 | — | 2.0 | bal. | | 8 | 152 | 160 | 95 | 66 |
| 39 | " | " | " | " | " | " | 20.0 | " | " | | 12 | 22 | 34 | 97 | 60 |

What is claimed is:

1. A iron base sintered, wear-resistant powder compact, consisting essentially of: 10–25% of Cu, 3–25% of Cr, 0.1–2% of P, 0.5–3% of C, 1–13% of at least two elements selected from the group consisting of 0.5–7% Mo, 0.1–8% W, 0.1–3% V and 0.5–2% Ni, and the balance being essentially Fe.

2. The wear-resistant powder compact as defined in claim 1, in which said copper is substituted with the same amount of a copper alloy.

3. The wear-resistant powder compact as defined in claim 2, in which said copper alloy is a Cu-Sn alloy.

4. The wear-resistant powder compact as defined in claim 2, in which said copper alloy is a Cu-Ni alloy.

5. The compact of claim 1, consisting essentially of: 10–25% of Cu, 3–25% of Cr, 0.1–2% of P, 0.5–3% of C, 0.1–3% V and 0.5–2% Ni, and the balance being essentially Fe.

6. A process for the production of iron base sintered, wear-resistant alloys, in which 10–25 weight % of copper or copper alloy powders and 0.5–3 weight % of carbon powders are added to the powders of an alloy consisting essentially of, in weight ratio, 3–25% of Cr, 0.1–2% of P, 1–13% of at least two elements selected from the group consisting of 0.5–7% Mo, 0.1–8% W, 0.1–3% V and 0.5–2% Ni and the balance being essentially Fe, and the resulting powders is sintered.

* * * * *

UNITED STATES PATENT AND TRADEMARK OFFICE

CERTIFICATE OF CORRECTION

PATENT NO. : 4,648,903

DATED : March 10, 1987

INVENTOR(S) : Yutaka Ikenoue, et al

It is certified that error appears in the above-identified patent and that said Letters Patent is hereby corrected as shown below:

Column 1, line 51: change "0.15 - 3%" to --0.5 - 3%--.

In TABLE 1, please delete Sample No. 9 and all entries to the right thereof.

Signed and Sealed this

Twenty-sixth Day of April, 1988

*Attest:*

*Attesting Officer*

DONALD J. QUIGG

*Commissioner of Patents and Trademarks*